US007422525B2

(12) United States Patent
Chang

(10) Patent No.: US 7,422,525 B2
(45) Date of Patent: Sep. 9, 2008

(54) FERRULE FOR POOL/BILLIARD CUE

(75) Inventor: Jung-Shih Chang, No. 32, Lane 25, Li Min Street, Ta Li City, Taichung Hsien (TW)

(73) Assignee: Jung-Shih Chang, Taichung (TW)

( * ) Notice: Subject to any disclaimer, the term of this patent is extended or adjusted under 35 U.S.C. 154(b) by 0 days.

(21) Appl. No.: 11/636,533

(22) Filed: Dec. 11, 2006

(65) Prior Publication Data

US 2008/0139329 A1 Jun. 12, 2008

(51) Int. Cl.
*A63D 15/12* (2006.01)

(52) U.S. Cl. ..... 473/49

(58) Field of Classification Search ..... 473/44–51
See application file for complete search history.

(56) References Cited

U.S. PATENT DOCUMENTS

| | | | | | |
|---|---|---|---|---|---|
| 860,381 | A * | 7/1907 | Holden | ..... | 473/49 |
| 1,033,071 | A * | 7/1912 | Le Duc | ..... | 473/49 |
| 1,444,093 | A * | 2/1923 | Atkins | ..... | 473/49 |
| 1,512,554 | A * | 10/1924 | Magono | ..... | 473/49 |
| 2,245,655 | A * | 6/1941 | Dukes | ..... | 473/49 |
| 3,204,961 | A * | 9/1965 | Salamone | ..... | 473/49 |
| 3,554,544 | A * | 1/1971 | Wodarczyk | ..... | 473/49 |
| 5,725,437 | A | 3/1998 | McCarty et al. | | |
| 6,117,019 | A * | 9/2000 | Taylor | ..... | 473/46 |
| 2001/0051546 | A1 * | 12/2001 | Wethered | ..... | 473/44 |

* cited by examiner

*Primary Examiner*—Mark S Graham
(74) *Attorney, Agent, or Firm*—Browdy and Neimark

(57) ABSTRACT

An improved ferrule of a billiard/pool cue includes a generally cylindrical body with an open end and an opposed closed end. An interior bore is formed in the body and extends inward from the open end of the body for a predetermined distance toward the closed end of the body. An isolated hollow room is formed in the body and located between the inner end of the bore and the closed end of the body. The ferrule is attached to a shaft of a billiard/pool cue by means of a tenon formed on the shaft. Whereby the ferrule can tightly engage with the shaft of the cue and in the same time absorb the impact forces generated during the impact of the cue on a ball.

11 Claims, 2 Drawing Sheets

FERRULE FOR POOL/BILLIARD CUE

BACKGROUND OF THE INVENTION

1. Field of the Invention

The present invention relates generally to pool/billiard cues, more particularly, to an improved ferrule for pool/billiard cues.

2. Description of the Related Art

A billiard/pool cue typically has an elongated shaft, a butt at one end of the shaft and a ferrule mounted at an opposite end which supports a tip. The ferrule is joined to one end of the shaft, typically by means of a tenon projecting out of the end of the shaft and inserted into a hollow bore extending inward from one end of the ferrule.

In use, if the cue is lined up to strike the cue ball off center, spin, draw or follow will impart to the cue ball to cause it to move in a desired direction after it strikes another ball or a rail.

It was well known that during off center hits, the tip, ferrule and the end of the shaft up to the player's hand bridge initially buckles due to loading of the impact forces generated during impact of the tip with a cue ball on the inside edge of the shaft closest to the center of the ball. According to experimentation, a large amount of buckling results in a larger and more undesirable deflection of the cue ball from a path of movement parallel to the cue stroke line than when buckling is minimized.

U.S. Pat. No. 5,725,437 discloses a billiard/pool cue having a ferrule with a hollow space when it is mounted on the shaft of the cue. Such a structure will absorb a portion of the impact forces so as to permit easy outward flexure of the tip end of the shaft. This outward flexure of the tip end of the shaft minimizes inward buckling of the tip end of the shaft on off center hits and results in less deflection of the cue ball from the line of stroke of the cue.

However, the billiard/pool cue mentioned above has a disadvantage that for forming the hollow space in the ferrule, the tenon of the shaft can only be inserted into the bore in the ferrule for a predetermined distance less than the total length of the bore. This limitation results in that the ferrule would easily be cracked or depart from the shaft of the cue.

Thus, it would be desirable to provide an improved ferrule for billiard/pool cue which can tightly engage with the shaft of the cue while forming a hollow space therein to absorb the impact forces generated during the impact of the cue on a ball and in the same time the absorbing impact force function thereof is better than that of any other prior art ferrules.

SUMMARY OF THE INVENTION

According to the present invention, an improved ferrule of a billiard/pool cue comprises a generally cylindrical body with an open end and an opposed closed end. An interior bore is formed in the body and extends inward from the open end of the body for a predetermined distance toward the closed end of said body. An isolated hollow room is also formed in the body and located between the inner end of the bore and the closed end of the body. The ferrule is attached to a shaft of a billiard/pool cue preferably by means of a tenon formed on the shaft. Preferably, the tenon is formed on the shaft and extends outward from the front end thereof into the bore of the ferrule.

BRIEF DESCRIPTION OF THE DRAWING

The various features, advantages and other uses of the present invention will become more apparent by referring to the following detailed description and drawing in which.

DETAILED DESCRIPTION OF THE INVENTION

Figure 1:
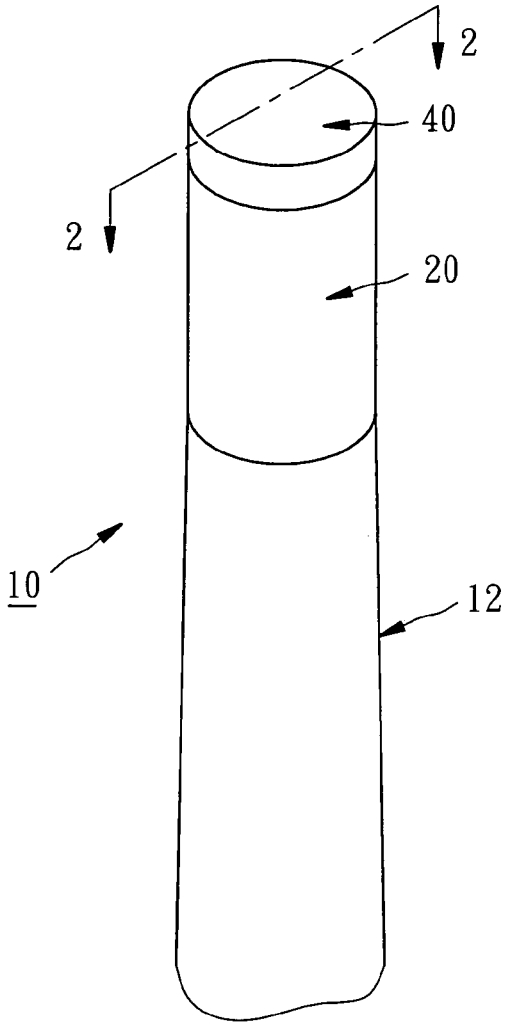
FIG. 1 is a fragmentary perspective view of a billiard/pool cue with a ferrule constructed in accordance of the present invention.
Figure 2:
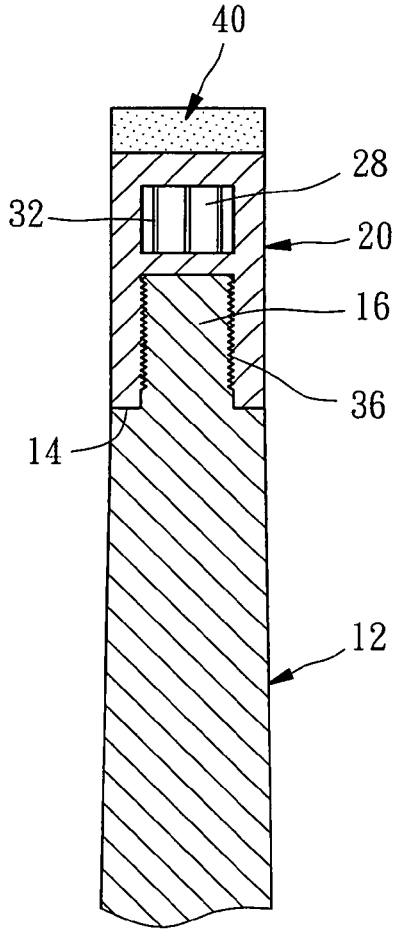
FIG. 2 is a cross sectional view taken along line 2-2 in FIG. 1.
Figure 3:
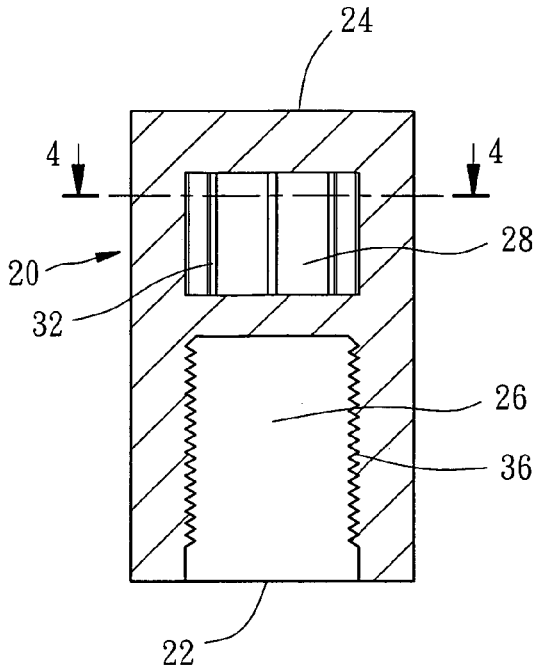
FIG. 3 is a cross sectional view of the ferrule shown in FIG. 1.
Figure 4:
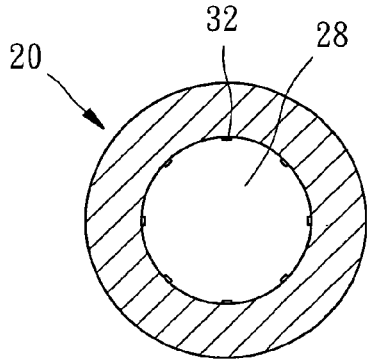
FIG. 4 is a cross sectional view taken along line 4-4 in FIG. 3.

Referring now to the drawings, a billiard cue 10 comprises a shaft 12 having a longitudinal axis, a ferrule 20 mounted on a distal end 14 of the shaft 12 and a tip 40 supported by the ferrule 20.

Figure 5:
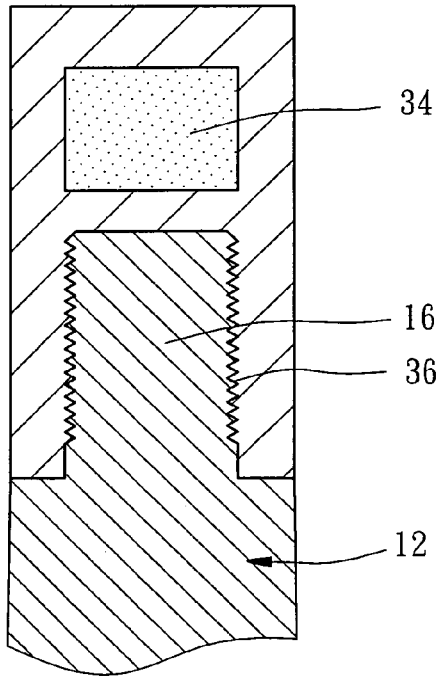
FIG. 5 is a cross sectional view as FIG. 2 showing a different embodiment constructed in accordance of the present invention.

The ferrule 20 is made of plastic materials and has a generally cylindrical body with an open end 22 and an opposed closed end 24. An interior bore 26 is formed in the body and extends inward from the open end 22 of the body for a predetermined distance toward the closed end 24 of the body. An isolated hollow room/chamber which is cylindrical 28 is also formed in the body and located between the inner end 30 of the bore 26 and the closed end 24 of the body. For avoiding deformation due to fatigue of materials, the interior wall of the hollow room 28 is provided with a plurality of reinforcing ribs 32. In addition, in the hollow room 28 a shock absorbing member 34 can be received to increase the shock absorbing ability thereof (as shown in FIG. 5).

The ferrule 20 is attached to the shaft 12 of the billiard cue 10 by means of a tenon 16. The tenon 16 is formed on the shaft 12 and extends longitudinally outward from the distal end 14 of the shaft 12. In combination, the tenon 16 is inserted into the bore 26 of the ferrule 20 in such a way that the front end of the tenon 16 is engaged against the inner end of the bore 26 to tightly engage the inner surface surrounding thereof. For getting a better engagement, the inner surface of the bore 22 can be provided with a threaded section 36.

As described above, the ferrule 20 constructed according to the present invention is provided with the isolated and sealed hollow room 28 in front of the shaft 12 when being attached thereto. Thus, the cue 10 can almost absorb the whole impact force generated during the impact of the cue 10 on a ball so that the buckling is minimized while permitting easier outward flex of the tip end of the shaft 12 to result in less deflection of a cue ball from the line of stroke of the cue shaft. In addition, the tenon 16 of the shaft 12 tightly engages the inner surface surrounding the bore 26 of the ferrule 20 so that the ferrule 20 and the shaft 12 can firmly attach to each other. Thus, the disadvantage of prior art is eliminated.

What is claimed is:

1. An improved ferrule of a billiard/pool cue, comprising:

a generally cylindrical body with an open end and an opposed closed end;

an interior bore extending from said open end of said body for a predetermined distance toward said closed end of said body;

a closed chamber formed by a top and a bottom wall and a vertical wall extending between the top and the bottom wall located between an inner end of said bore and said closed end of said body, and wherein the top, bottom and vertical walls have no opening therethough.

2. The ferrule of claim 1, wherein the interior peripheral wall of said bore has a threaded section.

3. The ferrule of claim 1, wherein said chamber is empty except for at least one reinforcing rib engaged on the inner surface of the vertical wall.

4. The cue tip assembly of claim 1, wherein the chamber is cylindrical.

5. A cue tip assembly for a cue stick, the cue stick having a shaft with a distal end, and a longitudinal axis, said assembly comprising:

a generally cylindrical ferrule having an open end, an opposed closed end, an interior bore extending from said open end of said body for a predetermined distance toward said closed end of said body, and a chamber closed by a top and a bottom wall and a vertical wall extending between the top and the bottom wall located between an inner end of and said closed end of said body;

wherein the top, bottom and vertical walls have no opening therethrough;

a tenon formed on and extending longitudinally outward from the distal end of the shaft, said tenon being inserted into said bore from said open end of said ferrule in such a way that a front end of said tenon is engaged against an inner end of said bore; and a tip mounted on said closed end of said ferrule.

6. The cue tip assembly of claim 5, wherein the interior peripheral wall of said bore has a threaded section.

7. The cue tip assembly of claim 5, wherein said chamber is empty except for a shock absorbing member engaged against the inner surface of the top, bottom and vertical walls.

8. The cue tip assembly of claim 7, wherein said shock absorbing member is made of resilient materials.

9. The cue tip assembly of claim 5, wherein the interior peripheral wall of said hollow room has at least a reinforced rib.

10. The cue tip assembly of claim 5, wherein at least one reinforcing rib is engaged on the inner surface of the vertical wall.

11. The cue tip assembly of claim 5, wherein the chamber is cylindrical.

* * * * *